United States Patent [19]

Kolle et al.

[11] Patent Number: 5,000,516

[45] Date of Patent: Mar. 19, 1991

[54] APPARATUS FOR RAPIDLY GENERATING PRESSURE PULSES FOR DEMOLITION OF ROCK HAVING REDUCED PRESSURE HEAD LOSS AND COMPONENT WEAR

[75] Inventors: Jack J. Kolle; David O. Monserud, both of Seattle, Wash.

[73] Assignee: The United States of America as represented by the Secretary of the Air Force, Washington, D.C.

[21] Appl. No.: 414,972

[22] Filed: Sep. 29, 1989

[51] Int. Cl.[5] ..... E21C 37/00

[52] U.S. Cl. ..... 299/16; 102/329; 137/1; 137/613

[58] Field of Search ..... 299/16, 13, 20, 21; 102/329, 330; 137/1, 624.24, 613, 624.11; 175/67; 166/177, 249, 308; 251/44

[56] References Cited

U.S. PATENT DOCUMENTS

| | | | |
|---|---|---|---|
| 3,198,204 | 8/1965 | Parks | 251/44 X |
| 3,415,269 | 12/1988 | Salerno | 251/44 X |
| 4,863,220 | 9/1989 | Kolle | 137/1 X |

*Primary Examiner*—Alan Cohan

*Attorney, Agent, or Firm*—Robert L. Nathans; Donald J. Singer

[57] ABSTRACT

An inlet chamber receives fluid from a small high pressure pump, such fluid flowing through a flow restrictor and one-way valve into an accumulator, until very high pressure is established in the accumulator. At the same time, a sealed poppet is pushed against a poppet seat by the high pressure within the inlet chamber to prevent fluid flow into an output chamber coupled to a bore hole. When the high pressure fluid in the accumulator is to be discharged into the output chamber, the inlet chamber is vented to the atmosphere to rapidly separate the poppet from the poppet seat. The poppet has an end portion having an area greater than the sealing area occupied by the poppet seat which permits the fluid under high pressure within the accumulator to rapidly separate the poppet from the valve seat so that a very large fraction of the energy in the accumulator is discharged through the outlet portion of the apparatus, to be injected into a bore hole for the purpose of fragmenting rock or the like.

31 Claims, 1 Drawing Sheet

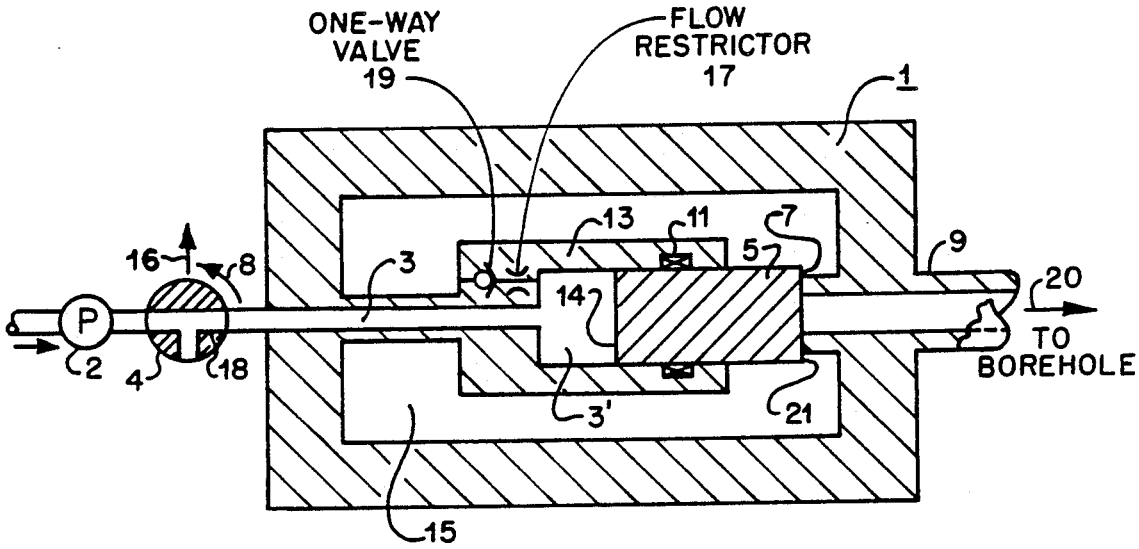
ONE-WAY
VALVE
19
FLOW
RESTRICTOR
17
1
13
11
7
5
9
16
8
3
14
20
P
2
4
18
TO
BOREHOLE
3'
21
15

APPARATUS FOR RAPIDLY GENERATING PRESSURE PULSES FOR DEMOLITION OF ROCK HAVING REDUCED PRESSURE HEAD LOSS AND COMPONENT WEAR

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of generating pressure pulses and more particularly a method of generating and utilizing such pulses for the demolition of rock formations and the like. It is desirable to provide for the generation of repeated short rise time pressure pulses from a hydraulic accumulator. It is known to build up very high pressure to rupture a disk which very abruptly releases the pressure from the accumulator. However, the use of such a disk has the disadvantage that the disk is destroyed, and the replacement of the ruptured disk is time consuming and costly. A high pressure rock demolition pulse generator is disclosed in copending application 07/287,195 filed 12/19/88 in the name of Jack Kolle, now U.S. Pat. No. 4,863,220 issued Sept. 5, 1989, whereby pressurization of the accumulator and discharge of the accumulator is accomplished through the use of only one reusable moving part, in contrast with the non-reusable disk. While this valve was effective, we found that it was subject to severe wear on the ball and cage assembly. In addition, a significant fraction of the stored energy in the accumulator was lost through the input pilot line due to the gap between the ball and the wall of the cage.

SUMMARY OF A PREFERRED EMBODIMENT OF THE INVENTION

It is thus an object of the present invention to provide a simple valve design having less wear than the aforesaid ball and cage assembly, and which may be used to discharge high pressure fluids very rapidly and with high reliability. Also, in contrast with the ball and cage assembly, the stored energy in the accumulator is not lost through the pilot line and thus the resulting reduced pressure head loss makes for greater efficiency.

An inlet chamber receives fluid from a high pressure pump, such fluid flowing through a flow restrictor and one-way valve into an accumulator, whereby very high pressure is established in the accumulator. At the same time, a sealed poppet is pushed against a poppet seat by the high pressure within the inlet chamber to prevent fluid flow into an output chamber coupled to the bore hole. When the high pressure fluid in the accumulator is to be discharged into the output chamber, the inlet chamber is vented to the atmosphere to separate the poppet from the poppet seat. The poppet has an end portion having an area greater than the seating area occupied by the poppet seat which permits the fluid under high pressure within the accumulator to rapidly separate the poppet from the valve seat so that a very large fraction of the energy in the accumulator is discharged through the outlet portion of the apparatus, to be injected into a bore hole for the purpose of fragmenting rock or the like.

Other objects features and advantages of the invention will become apparent upon study of the following detailed description taken in conjunction with the sole FIGURE illustrating the preferred embodiment in cross-section.

DETAILED DESCRIPTION OF A PREFERRED EMBODIMENT OF THE INVENTION

A high pressure water pump 2 pumps water into an inlet chamber 3 via valve 4, which in turn causes pressure to be asserted against the left hand portion 14 of slidable unitary mechanically unbiased cylindrical poppet, 5, causing the right hand portion of the cylindrical poppet to seated against poppet seat 7. At the same time, fluid continues to flow through flow restrictor 17, and one-way check valve 19, until accumulator 15 is filled with water under high pressure. Since the poppet is positioned against poppet seat means 7 in its first position, outlet chamber 9 is isolated from the high fluid pressure within accumulator 15.

When it is desired to produce a high energy fluid impulse in outlet chamber 9, valve 4 is rotated in the direction of arrow 8, to cause portion 18 to be vertically oriented as indicated by arrow 16 so that inlet chamber 3 is vented to the atmosphere. It is an important feature of the invention that the cross-sectional area of the right hand portion of the cylindrical poppet is greater than the cross-sectional area of the poppet seat means 7, so than an annular ledge 21 is exposed to the high fluid pressure in the accumulator 15. Since the pressure in inlet chamber 3 is now at atmospheric pressure, the high pressure in accumulator 15 will be asserted against the annular ledge 21, coplanar with the surface of the poppet seating means 7, to cause very rapid acceleration of cylindrical poppet 5 to the left, resulting in the discharge of the high pressure in accumulator 15 through outlet chamber 9, and into the bore hole schematically illustrated by arrow 20. The poppet is sealed, that is, it is positioned within the cylindrical inlet chamber portion 3' by an annular seal or gasket 11. In contrast with the aforesaid ball-cage arrangement of the prior patent application discussed above, fluid under high pressure does not pass from the accumulator into the inlet chamber 3 during production of the high impulse output of the device.

Before a second high pressure impulse is to be generated, valve 4 is rotated 90° to again assume the position shown in the figure so that high pressure pump 2 again causes cylindrical poppet 5 to be moved to the right and be seated against poppet seat means 7. The valve is again rotated in the direction indicated by arrow 8 and the process is repeated. Thus the aforesaid apparatus utilizes a simple valve design which may be used to discharge very high pressure fluids very rapidly and with high reliability. Pump 2 introduces fluid into the accumulator until the pressure therein reaches about 40,000–60,000 psi.

Thus, the aforesaid apparatus calls for a flow restrictive fluid conduit means for producing a substantial pressure drop extending from accumulator 15 and toward inlet chamber 5, to prevent a substantial flow rate of fluid back into the inlet chamber during discharge of the accumulator into the outlet chamber, which would otherwise significantly lessen the impulse energy discharged through the outlet chamber, and lessen the output chamber pressure head. While the use of a one-way valve 19 is preferred for this purpose, it could be eliminated if a highly throttled passageway or other type of flow restrictor was employed. A small, economical high pressure pump 2 could pump fluid through the throttled passageway for a period of say one minute, until the accumulator pressure was typically 40–60 thousand psi. The release of accumulator fluid into the outlet chamber is quite rapid, so that little energy would be lost due to a limited accumulator fluid backflow into the inlet chamber, via the throttled passageway. Conversely, a strictly non-leaky valve would not require an additional flow restrictor.

Also, flow restrictor 17 ensures prompt seating of the poppet on the poppet seating means to isolate the output chamber from the accumulator, during charging of the accumulator. The presently preferred arrangement under test is a one-way valve 19 in tandem with flow restrictor 17 which has a forty mil diameter, both components comprising the aforesaid flow restrictive fluid conduit means.

While there has been described what is at present considered to be the preferred embodiments of this invention, it will be obvious to those skilled in the art that various changes and modifications may be made therein without departing from the invention and it is, therefore, intended in the appended claims to cover all such changes and modifications as fall within the true spirit and scope of the invention, including art recognized equivalents.

What is claimed is:

1. Method of producing a very high fluid pressure pulse comprising the steps of:

(a) providing a fluid pressure pulse generator having a fluid inlet chamber, communicating with an accumulator, via a fluid conduit means for creating a substantial pressure drop extending from said accumulator toward said fluid inlet chamber, an outlet chamber coupled to a poppet seat means for preventing communication between said outlet chamber and said accumulator when a sealed poppet assumes a first position against said poppet seat means, and for permitting said outlet chamber to communicate with said accumulator when said sealed poppet is separated from said poppet seat means when said poppet assumes a second position said sealed poppet contacting sealing means for preventing fluid flow around said poppet regardless of its position;

(b) introducing fluid into said fluid inlet chamber for causing said fluid to flow from said inlet chamber into said accumulator until fluid pressure therein in very high, and for causing said poppet to assume said first position against said poppet seat means; and (c) thereafter reducing fluid pressure within said inlet chamber for causing high fluid pressure within said accumulator to unseat said poppet from said poppet seat means to in turn cause high impulse ejection of fluid from said accumulator into said outlet chamber.

2. The method of claim 1 wherein said poppet comprises a cylinder having an end portion positioned against said poppet seat means during the performance of step (b), said end portion extending beyond said poppet seat means for permitting the fluid under high pressure within said accumulator to separate said poppet from said valve seat means during the performance of step (c).

3. The method of claim 1 wherein water is pumped into said inlet chamber to fill said accumulator during the performance of step (b).

4. The method of claim 2 wherein water is pumped into said inlet chamber to fill said accumulator during the performance of step (b).

5. The method of claim 1 wherein said fluid is pumped into said accumulator until the pressure therein reaches about 40,000–60,000 psi or more.

6. The method of claim 2 wherein said fluid is pumped into said accumulator until the pressure therein reaches about 40,000–60,000 psi or more.

7. The method of claim 3 wherein said fluid is pumped into said accumulator until the pressure therein reaches about 40,000–60,000 psi or more.

8. The method of claim 1 wherein said fluid is pumped into said accumulator until the pressure therein reaches about 40,000–60,000 psi or more.

9. The method of claim 1 further including the step of introducing said high impulse ejection of fluid within a rock formation for shattering said rock formation.

10. The method of claim 2 further including the step of introducing said high impulse ejection of fluid within a rock formation for shattering said rock formation.

11. The method of claim 3 further including the step of introducing said high impulse ejection of fluid within a rock formation for shattering said rock formation.

12. The method of claim 4 further including the step of introducing said high impulse ejection of fluid within a rock formation for shattering said rock formation.

13. The method of claim 5 further including the step of introducing said high impulse ejection of fluid within a rock formation for shattering said rock formation.

14. The method of claim 1 wherein step (c) is carried out by venting said inlet chamber to the atmosphere.

15. The method of claim 4 wherein step (c) is carried out by venting said inlet chamber to the atmosphere.

16. The method of claim 5 wherein step (c) is carried out by venting said inlet chamber to the atmosphere.

17. Apparatus for producing a very high fluid pressure pulse comprising:

(a) a fluid pressure pulse generator having a fluid inlet chamber in communication with an accumulator via flow restrictive fluid conduit means for providing a substantial pressure drop extending from said accumulator toward said inlet chamber, an outlet chamber coupled to a poppet seat means for preventing communication between said outlet chamber and accumulator when a sealed poppet assumes a first position against said poppet seat means, and for permitting said outlet chamber to communicate with said accumulator when said sealed poppet is separated from said poppet seat means when said poppet assumes a second position, said sealed poppet contacting sealing means for preventing fluid flow around said poppet regardless of its position;

(b) means for introducing fluid within said fluid inlet chamber for permitting said fluid to flow from said inlet chamber into said accumulator until fluid pressure therein is very high and for also causing said poppet to assume said first position against said poppet seat means; and (c) means for thereafter reducing fluid pressure within said inlet chamber for permitting high fluid pressure within said accumulator to rapidly unseat said poppet from said poppet seat means to in turn cause high impulse ejection of fluid from said accumulator into said outlet chamber.

18. The apparatus of claim 17 wherein said poppet comprises a cylinder having an end portion communicating with said accumulator and extending beyond said poppet seat means, permitting fluid under high pressure within said accumulator to rapidly separate said poppet from said valve seat means.

19. The apparatus of claim 18 wherein said sealing means comprises an annular sealing gasket surrounding said cylinder and an annular end portion of said cylinder is exposed to fluid within said accumulator when said cylinder is seated against said seating means.

20. Apparatus of claim 19 wherein said annular end portion comprises an annular ledge coplanar with a poppet contact surface of said poppet seating means.

21. Apparatus of claim 17 wherein said last named means comprises a valve for venting said fluid inlet chamber to atmospheric pressure.

22. Apparatus of claim 17 wherein said fluid conduit means includes a constricted fluid conducting passageway for restricting fluid flow from said accumulator back into said inlet chamber.

23. Apparatus of claim 17 wherein said fluid conduit means includes a one-way valve for restricting fluid flow from said accumulator back into said inlet chamber.

24. Apparatus of claim 22 wherein said fluid conduit means includes a one-way valve for restricting fluid flow from said accumulator back into said inlet chamber.

25. Apparatus of claim 24 wherein said constricted fluid conducting passageway has a diameter of about forty mils.

26. Apparatus for producing a very high fluid pressure pulse comprising:

(a) a fluid pressure pulse generator having a fluid inlet chamber in communication with an accumulator, an outlet chamber, coupled to a poppet seat means for preventing communication between said outlet chamber and said accumulator when a sealed poppet assumes a first position against said poppet seat means, and for permitting said outlet chamber to communicate with said accumulator when said sealed poppet is separated from said poppet seat means when said poppet assumes a second position;

(b) means for introducing fluid within said fluid inlet chamber for causing said fluid to flow from said inlet chamber into said accumulator until fluid pressure therein is very high and for also causing said fluid to press against a first portion of said poppet so that said poppet assumes said first position against said poppet seat means;

(c) means for thereafter reducing fluid pressure within said inlet chamber for permitting high fluid pressure within said accumulator to rapidly unseat said poppet from said poppet seat means to in turn cause high impulse ejection of fluid from said accumulator into said outlet chamber.

27. The method of claim 1 wherein step (c) is performed solely by a fluid pressure differential across said poppet, thereby to eliminate the need for mechanically biasing said poppet.

28. Apparatus of claim 17 wherein said poppet consists essentially of a mechanically unbiased unitary body.

29. Apparatus for producing a very high fluid pressure pulse comprising:

(a) a fluid pressure pulse generator having a fluid inlet chamber in communication with an accumulator via a flow restrictive fluid means for providing a substantial pressure drop extending from said accumulator toward said inlet chamber, an outlet chamber coupled to a poppet seat means for preventing communication between said outlet chamber and said accumulator when a sealed poppet assumes a first position against said poppet seat means, and for permitting said outlet chamber to communicate with said accumulator when said sealed poppet is separated from said poppet seat means when said poppet assumes a second position, said sealed poppet contacting sealing means for preventing fluid flow around said poppet regardless of its position;

(b) means for introducing fluid within said fluid inlet chamber for permitting said fluid to flow from said inlet chamber into said accumulator until fluid pressure therein is very high and for also causing said poppet to assume said first position against said poppet seat means; and (c) means for thereafter reducing fluid pressure within said inlet chamber for causing high fluid pressure within said accumlator to unseat said poppet from said poppet seat means to in turn cause high impulse ejection of fluid from said accumulator into said outlet chamber; and wherein said poppet comprises a unitary mechanically unbiased cylinder having an end portion communication with said accumulator and extending beyond said poppet seat means, permitting fluid under high pressure within said accumulator to press against said end portion to rapidly separate said poppet from said valve seat means by virtue of said end portion upon the reduction of pressure within said inlet chamber.

30. Apparatus of claim 17 wherein said apparatus has only one inlet chamber.

31. Apparatus of claim 29 wherein said apparatus has only one inlet chamber.

* * * * *